US010486032B2

(12) United States Patent
Hall

(10) Patent No.: US 10,486,032 B2
(45) Date of Patent: Nov. 26, 2019

(54) SYSTEMS AND METHODS FOR TRACKING SPORTS BALLS CONFIGURED WITH ELECTRONIC COMPONENTS

(71) Applicant: SportsMEDIA Technology Corporation, Durham, NC (US)

(72) Inventor: Gerard J. Hall, Durham, NC (US)

(73) Assignee: SPORTSMEDIA TECHNOLOGY CORPORATION, Durham, NC (US)

( * ) Notice: Subject to any disclaimer, the term of this patent is extended or adjusted under 35 U.S.C. 154(b) by 1 day.

(21) Appl. No.: 15/915,807

(22) Filed: Mar. 8, 2018

(65) Prior Publication Data

US 2018/0256945 A1 Sep. 13, 2018

Related U.S. Application Data

(60) Provisional application No. 62/469,342, filed on Mar. 9, 2017.

(51) Int. Cl.

| | |
|---|---|
| ***A63B 43/00*** | (2006.01) |
| ***A63B 60/46*** | (2015.01) |
| ***A63B 67/14*** | (2006.01) |
| ***A63B 37/00*** | (2006.01) |
| ***A63B 39/00*** | (2006.01) |
| ***A63B 41/02*** | (2006.01) |

(Continued)

(52) U.S. Cl.

CPC ..... *A63B 43/004* (2013.01); *A63B 37/0003* (2013.01); *A63B 39/00* (2013.01); *A63B 41/02* (2013.01); *A63B 60/46* (2015.10); *A63B 67/14* (2013.01); *A63B 2102/02* (2015.10); *A63B 2102/14* (2015.10); *A63B 2102/18* (2015.10); *A63B 2102/24* (2015.10); *A63B 2102/32* (2015.10); *A63B 2220/10* (2013.01); *A63B 2220/16* (2013.01); *A63B 2220/30* (2013.01); *A63B 2220/34* (2013.01); *A63B 2220/40* (2013.01); *A63B 2225/20* (2013.01); *A63B 2225/50* (2013.01); *A63B 2225/54* (2013.01);

(Continued)

(58) Field of Classification Search

None

See application file for complete search history.

(56) References Cited

U.S. PATENT DOCUMENTS

| | | | |
|---|---|---|---|
| 7,095,312 | B2 | 8/2006 | Erario et al. |
| 8,353,791 | B2 | 1/2013 | Holthouse et al. |

(Continued)

OTHER PUBLICATIONS

Hall, G. J. U.S. Appl. No. 62/469,342 , Provisional Patent Application; Entire Document.

*Primary Examiner* — Ronald Laneau

(74) *Attorney, Agent, or Firm* — NEO IP

(57) ABSTRACT

Systems and methods for tracking a sports ball assembly in real time during a sporting event are disclosed. A structure of the sports ball assembly is also disclosed. The sports ball assembly comprises at least one electronic circuit embedded or attached to a sports ball. The sports ball assembly is in network communication with a server processor via at least two receivers within a sports arena. The sports ball assembly generates and transmits UWB data packets comprising movement-related data for the sports ball assembly in real time at a predetermined rate. The at least two receivers receive the UWB data packets and transmit to the server processor with time stamps. The server processor is operable to determine a movement of the sports ball assembly based on the UWB data packets and the time stamps received from the at least two receivers.

20 Claims, 7 Drawing Sheets

(51) Int. Cl.

| | |
|---|---|
| *A63B 102/18* | (2015.01) |
| *A63B 102/32* | (2015.01) |
| *A63B 102/02* | (2015.01) |
| *A63B 102/14* | (2015.01) |
| *A63B 102/24* | (2015.01) |

(52) U.S. Cl.

CPC . *A63B 2243/007* (2013.01); *A63B 2243/0025* (2013.01); *A63B 2243/0037* (2013.01); *A63B 2243/0066* (2013.01); *A63B 2243/0095* (2013.01)

(56) References Cited

U.S. PATENT DOCUMENTS

| | | | | |
|---|---|---|---|---|
| 8,506,430 | B2 | 8/2013 | Gruen et al. | |
| 8,512,177 | B2 | 8/2013 | Krysiak et al. | |
| 8,517,870 | B2 | 8/2013 | Crowley et al. | |
| 8,870,689 | B2 | 10/2014 | Krysiak et al. | |
| 8,870,690 | B2 | 10/2014 | Krysiak et al. | |
| 2005/0202905 | A1* | 9/2005 | Chesser | A63B 24/0021 473/415 |
| 2006/0105857 | A1 | 5/2006 | Stark | |
| 2008/0021651 | A1* | 1/2008 | Seeley | A63B 24/0021 702/3 |
| 2010/0130314 | A1* | 5/2010 | Von Der Gruen | A63B 63/00 473/570 |
| 2011/0077112 | A1 | 3/2011 | Erario et al. | |
| 2012/0244969 | A1* | 9/2012 | Binder | A63H 33/18 473/570 |
| 2014/0128171 | A1 | 5/2014 | Anderson | |
| 2014/0200103 | A1 | 7/2014 | Thurman et al. | |
| 2015/0157900 | A1 | 6/2015 | Holthouse | |
| 2015/0182810 | A1 | 7/2015 | Thurman et al. | |
| 2016/0074714 | A1 | 3/2016 | Krysiak et al. | |

* cited by examiner

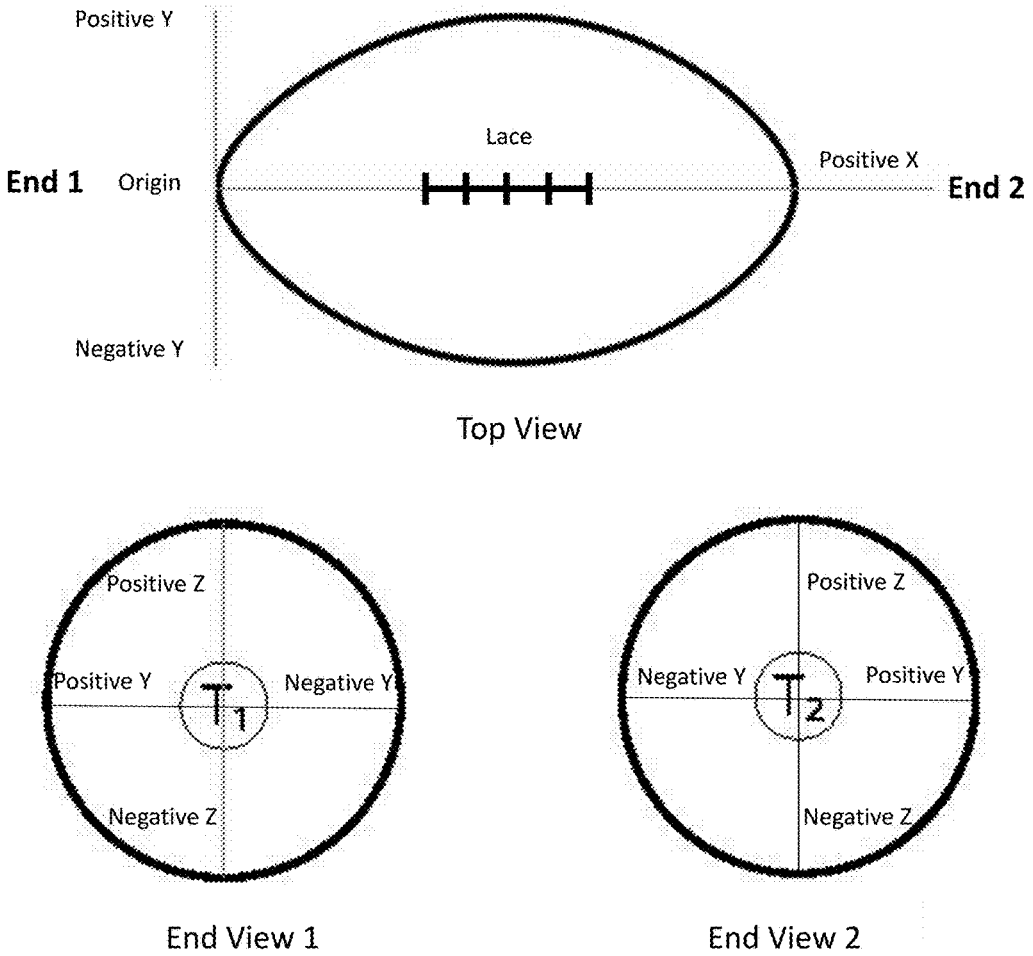
FIG. 1
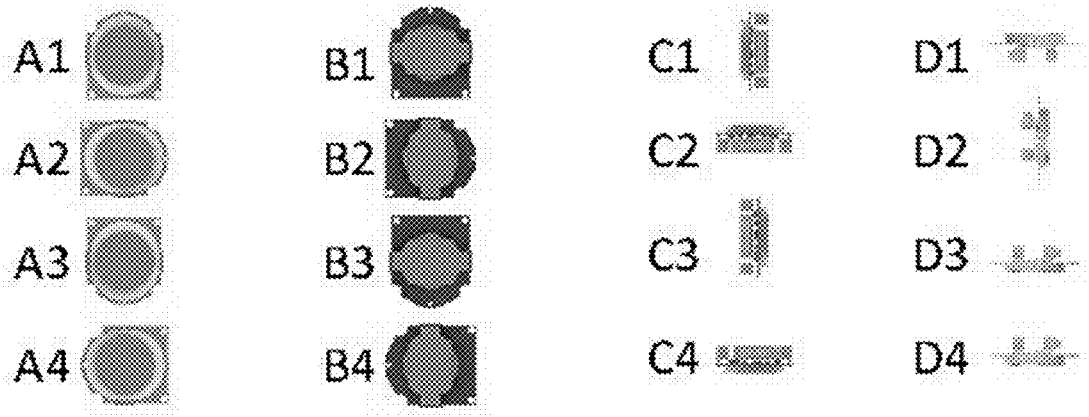

Side View

End View 1

End View 1

Side View

End View 1

End View 1

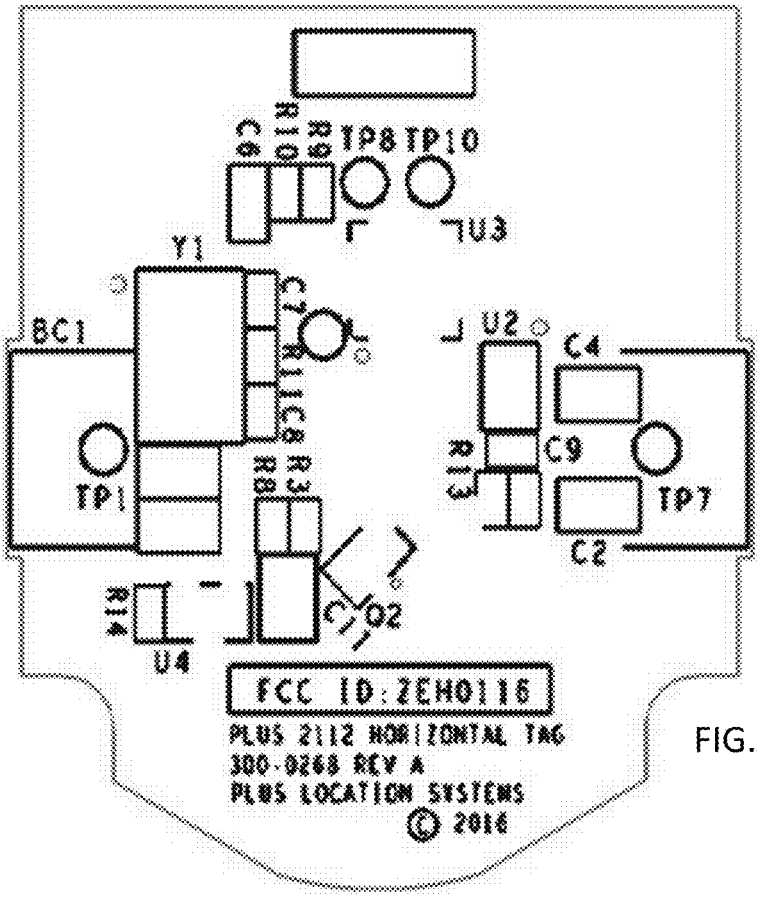
FIG. 4
FIG. 5
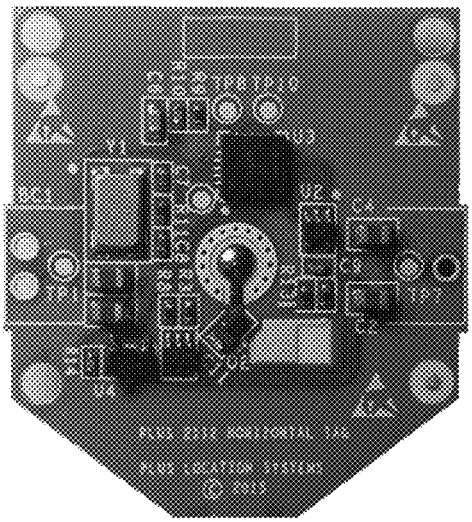
FIG. 6
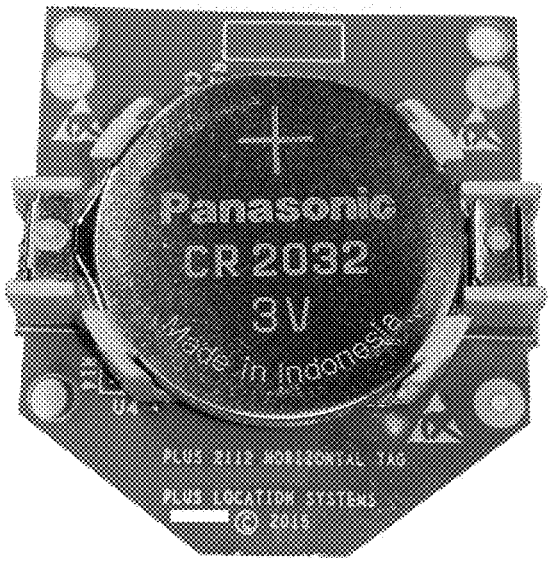

SYSTEMS AND METHODS FOR TRACKING SPORTS BALLS CONFIGURED WITH ELECTRONIC COMPONENTS

CROSS-REFERENCES TO RELATED APPLICATIONS

The present invention is related to and claims priority from the following U.S. patent documents: this application claims priority from U.S. Provisional Patent Application No. 62/469,342 filed Mar. 9, 2017, which is incorporated herein by reference in its entirety.

BACKGROUND OF THE INVENTION

1. Field of the Invention

The present invention is directed to tracking a sports ball including internally embedded or attached electronic components.

2. Description of the Prior Art

The development of sensing and communication technologies is changing many industries. In this information era, more and more data can be collected and analyzed to provide more insight than ever before. For example, in the sports industry, different tags or sensors are developed for players to wear on certain parts of their bodies in a sporting event or during training and practice sessions. These tags or sensors collect movement data, biometric data, etc. from the players, which can be used for statistics and analytics and providing actionable or digestible information to coaches, managers, medical staff, players, broadcasters, fans, and viewers.

By way of example the following are relevant representative prior art documents relating to sports balls embedded with electronic components.

U.S. Pat. No. 8,512,177 for "American-style football including improved bladder construction for mounting of electronics" by inventor Kevin L. Krysiak et al. filed Nov. 17, 2010, describes an American style football including an inflatable bladder, a cover surrounding the bladder, and an electronic circuit. The bladder includes first and second side walls defining an expandable cavity and a cross-member configured to extend through the expandable cavity. The side walls and cross-member are coupled together to form a bladder seam. The electronic circuit is coupled to the cross-member and produces a signal to enable the position and movement of the football to be monitored during use.

U.S. Pat. No. 8,870,689 for "American-style football including electronics coupled to the bladder" by inventor Kevin L. Krysiak et al. filed Nov. 17, 2010, describes an American style football including an inflatable bladder, a cover surrounding the bladder, a lacing coupled to the at least one cover panel, and an electronic circuit. The electronic circuit is coupled to the bladder. The electronic circuit includes at least one sensor and the electronic circuit being configured to produce a signal to enable the position and movement of the football to be monitored during use.

U.S. Pat. No. 8,870,690 for "American-style football including electronics" by inventor Kevin L. Krysiak et al. filed Nov. 17, 2010, describes an American style football including an inflatable bladder, at least two cover panels surrounding the bladder, a lacing coupled to the at least one cover panel, and an electronic circuit. Each of the cover panels includes an outermost layer and a lining. The electronic circuit is coupled to at least one of the cover panels. The electronic circuit includes at least one sensor. The electronic circuit is configured to produce a signal to enable the position and movement of the football to be monitored during use.

U.S. Patent Publication No. 2015/0182810 for "Football Sensing" by inventor Robert T. Thurman et al. filed Mar. 11, 2015, describes a football sensing system including an American-style football extending along a longitudinal axis and having a maximum transverse dimension defining a transverse axis and at least one accelerometer carried by the football to sense acceleration of the football along at least a first axis. The accelerometer is sized to sense a predetermined maximum value of acceleration in the first axis. The accelerometer is positioned within the football in a first position with the first axis of the accelerometer angled with respect to the longitudinal axis of the football. The accelerometer in the first position is capable of measuring acceleration values in a direction in line with or parallel to the longitudinal axis of the football that are greater than the predetermined maximum value of acceleration in the first axis.

U.S. Patent Publication No. 2014/0200103 for "Basketball Electronics Support" by inventor Robert T. Thurman et al. filed Mar. 14, 2014, describes a game ball supporting electronics. In one implementation, the electronics sense motion of the game ball and are encapsulated by potting compound which forms an encapsulating body sized and shaped to fit within a cavity of the game ball. In one implementation, a game ball comprises an inflatable body which supports the electronics, wherein an electrical conductive line is electrically connected to electronics extends along a surface of the inflatable body at least 60 degrees about the inflatable body.

U.S. Patent Publication No. 2016/0074714 for "Basketball with Electronics" by inventor Kevin Krysiak et al. filed Nov. 19, 2015, describes a basketball including a bladder, electronics within the bladder proximate an outer portion of the bladder, windings about the bladder, and a molded elastomeric layer about the bladder and extending over the electronics.

U.S. Pat. No. 8,517,870 for "Electronic component enclosure for an inflated object" by inventor Michael J. Crowley et al. filed Sep. 7, 2010, describes methods and materials for securely retaining electronic components within an inflatable object. For example, basketballs having a boot structure for securely retaining one or more electronic components (e.g., a sensor and/or a battery) within the basketball are provided.

U.S. Pat. No. 8,506,430 for "Oval ball, especially rugby ball or football" by inventor Thomas Von Der Gruen et al. filed Oct. 21, 2009, describes an oval ball, in particular rugby ball or football with a casing and with at least one electronic component or module with a transmitter unit. The at least one electronic component is arranged in the casing and is held in a defined position, wherein the at least one electronic module is fastened on or in a shape part with a positive and/or material fit, in the region of the tips or in the region of a valve of the casing. In a further embodiment, the module is suspended on nets which are connected to the tip region of the casing in a large-surfaced manner.

U.S. Pat. No. 8,353,791 for "Tracking balls in sports" by inventor Shaun Holthouse et al. filed Aug. 14, 2008, describes a system for tracking balls in sports in which players kick, pass, bounce, strike or carry a ball. The ball is equipped with two beacons pulsing in the 5-10 Hz range at a frequency which is not attenuated by the body of the players. one beacon has a very short range of 40-120 cm and the other has a range of 1-5 meters. A data logger worn by the players includes a clock, location and speed sensors, a receiver for the beacon signals and a micro controller to record the data from all the sensors. The micro controller is able to record whether the player is in possession of the ball or is contesting the ball. The path of the ball from player to player is tracked relative to the playing field. An impact or pressure sensor may be fitted to the players footwear, glove or a bat stick, club or racquet to register a kick or ball strike.

U.S. Patent Publication No. 20150157900 for "Tracking Balls in Sports" by inventor Shaun Holthouse filed Jan. 6, 2015, describes an electronically trackable ball consisting of a cover, an inflatable bladder, a valve in the bladder a mounting structure attached to said valve and extending inwardly of the valve toward the centre of the inflated bladder and an electronic transmission device on said mounting structure remote from said valve. The mounting structure is preferably a lightweight polymeric cylinder with the electronics fitted at the end remote from the valve and close to the centre of mass of the ball. The device is within the ball, and is constrained from moving around inside the ball.

U.S. Pat. No. 7,095,312 for "System and method for tracking identity movement and location of sports objects" by inventor John Erario et al. filed May 19, 2004, describes a method and apparatus for tracking location and flight path attributes of one or more sports objects, associating the sports objects with individual players, mapping each sports object location and a flight path to surrounding field of play, and allowing each player to access the location and flight path attributes of their sports objects. The present invention outfits sports objects with electronic devices that receive and transmit position and location information obtained from the Global Positioning Satellite (GPS) System, without adversely affecting the sports object's ability to perform in a standard way.

U.S. Patent Publication No. 2006/0105857 for "Athletic ball telemetry apparatus and method of use thereof" by inventor David A. Stark filed Nov. 17, 2004, describes an athletic ball includes a receiver, a processor, a transmitter, a power source and/or a multiplexing signal relay. The athletic ball receives GPS signal date from earth-orbiting satellites in order to determine the location of the ball. An output device is utilized to display the ball location and/or provide analytical data pertaining to movement of the athletic ball.

U.S. Patent Publication No. 2011/0077112 for "Electronics Modules Support System for Use with Sports Objects" by inventor Richard Erario et al. filed Sep. 30, 2010, describes a method and apparatus for suspending core electronics in a sports object is disclosed. The suspension is accomplished in such a manner as to protect the electronics from impact during normal play of the sports object. In one embodiment, a web like membrane is used to suspend the electronics in the sports object. Other embodiments include use of an impact absorbing memory foam, an air inflated inner core, or a flexible membrane in any combination with or without the web-like design, or individually used, suspend and support the core electronics while providing protection to the core electronics.

U.S. Patent Publication No. 2014/0128171 for "Golf Ball Tracking System" by inventor Derek Anderson filed Nov. 8, 2012, describes a golf ball tracking system that includes a golf ball, a GPS chip that is embedded within the golf ball and a hand-held tracker that includes a front, a casing, a transmitter, a LCD display and a beeper. The transmitter is encased within the casing and the LCD display is disposed on the front of the hand-held tracker and the transmitter is in communication with the GPS chip embedded within the golf ball through a GPS system. The golf ball tracking system includes one or more batteries encased within the casing, the one or more batteries provide electrical power to the golf ball tracking system and a packaging that contains one or more of the golf balls.

SUMMARY OF THE INVENTION

The present invention is directed to systems, methods, and apparatuses for tracking a sports ball assembly in real time. In one embodiment, the sports ball assembly is in network communication with a server processor via at least two receivers within a sports arena. The sports ball assembly comprises at least one electronic circuit constructed and configured within a sports ball. The at least one electronic circuit is positioned within the sports ball a predetermined distance away from at least one point on the surface of the sports ball. The at least one electronic circuit generates and transmits data packets comprising movement-related data for the sports ball assembly in real time at a predetermined rate. The at least two receivers receive the data packets, create time stamps for the data packets, and transmit the data packets with the time stamps to the server processor. The server processor determines a movement of the sports ball assembly in real time or near real time based on the data packets and the time stamps received from the at least two receivers.

In one embodiment, a pair of electronic tags are located inside the sports ball and transmit location data and other movement-related data, for example, acceleration, and direction information, to at least three receivers installed inside a sporting venue. These movement-related data are collected and processed to provide accurate position and other valuable information.

In one embodiment, the present invention is directed to systems, methods, and apparatuses for tracking a sports element including embedded or attached electronic components. Sports elements include balls, objects, and any other sports equipment. In one embodiment, the sports element is a ball, inflatable or non-inflatable, including by way of example and not limitation, a baseball, a basketball, a football, a soccer ball, a volleyball, a lacrosse ball, a rugby ball, a golf ball, a tennis ball, or any other type of ball. In one embodiment, the sports element is a sports object, including by way of example and not limitation, a hockey puck, a flying disc, a helmet, a baseball bat, a hockey stick, a lacrosse stick, a tennis racket and other sports objects.

These and other aspects of the present invention will become apparent to those skilled in the art after a reading of the following description of the preferred embodiment when considered with the drawings, as they support the claimed invention.

BRIEF DESCRIPTION OF THE DRAWINGS

FIG. 1 is a schematic diagram of a football with a pair of electronic tags with different orientations.

FIG. 4 is a Printed Wiring Board (PWB) schematic for a PLUS 2112 modular tag in one embodiment of the present invention.

FIG. 5 is a Printed Wiring Assembly (PWA) for a PLUS 2112 modular tag in one embodiment of the present invention.

FIG. 6 is a PWA with battery for a PLUS 2112 modular tag in one embodiment of the present invention.

DETAILED DESCRIPTION

Figure 2:
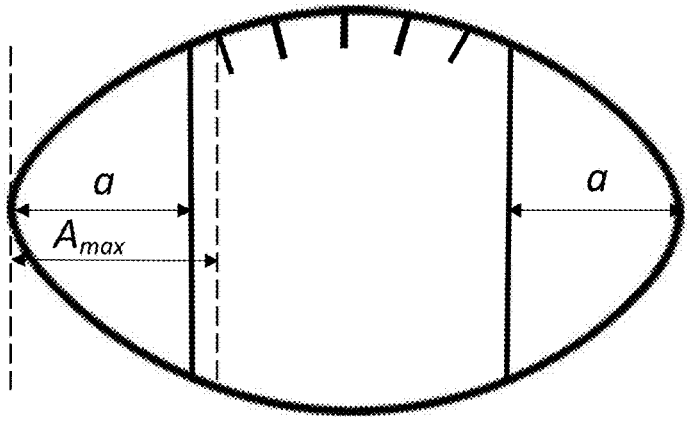
FIG. 2 shows a side view and two end views of a football in one embodiment of the present invention.
Figure 2:
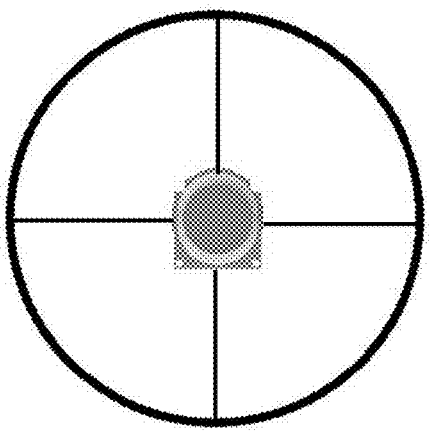
Figure 2:
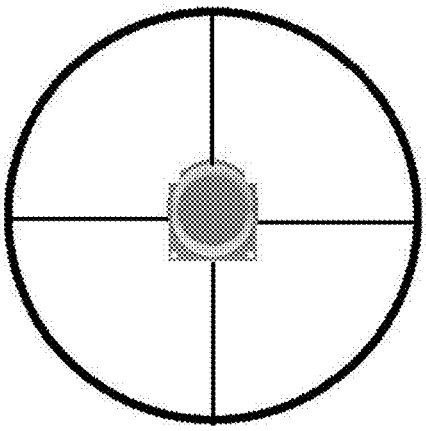

The present invention is directed to systems and methods for tracking a sports ball assembly in real time during a sporting event. The sports ball assembly is in network communication with a server processor via at least two receivers within a sports arena. The sports ball assembly comprises at least one electronic circuit constructed and configured within a sports ball. The at least one electronic circuit generates and transmits data packets comprising movement-related data for the sports ball assembly in real time at a predetermined rate. The at least two receivers receive the data packets, create time stamps for the data packets, and transmit the data packets with time stamps to the server processor. The server processor determines a movement of the sports ball assembly in real time or near real time based on the data packets and the time stamps received from the at least two receivers.

In one embodiment, a pair of electronic tags are located inside a sports ball and transmit location data and other movement-related data, for example, acceleration and direction information, to at least three receivers installed inside a sporting venue. These movement-related data are collected and processed to provide accurate position data and other valuable information.

In one embodiment, at least two electronic components are constructed and configured within a sports ball for transmitting signals. In one embodiment, the sports ball is an inflatable ball and the at least two electronic components include a pair of electronic tags that are attached to or embedded in the sports ball. The at least two electronic components are operable to transmit location data and other movement-related data in real time to at least three receivers installed inside a sports arena. By way of example and not limitation, movement-related data includes acceleration, speed, velocity, changes in altitude, impact speed against a player or body part of a player, impact speed against a court surface or field surface, angle of movement, rotational speed, angle of rotation, changes in angles of rotation, direction information, changes in direction, etc. The at least three receivers within the sports arena are operable to receive signals from the at least two electronic components in the sports ball, create time stamps for the signals, and transmit the signals with time stamps to a server platform. The server platform collects and processes the signals and the time stamps from the at least three receivers to provide accurate position information of the sports ball and other valuable information in real time or near real time.

In one embodiment, the present invention is directed to systems, methods, and apparatuses for tracking a sports element including electronic components embedded in or attached to the sports element in real time. Sports elements includes balls, objects, and any other sports equipment. In one embodiment, the sports element is a ball, inflatable or non-inflatable, such as by way of example and not limitation, a baseball, a basketball, a football, a soccer ball, a volleyball, a lacrosse ball, a rugby ball, a golf ball, a tennis ball, or any other type of sports ball. In one embodiment, the sports element is a sports object, such as by way of example and not limitation, a hockey puck, a flying disc, a helmet, a baseball bat, a hockey stick, a lacrosse stick, a tennis racket, and any other sports object in a sporting event.

In one embodiment, a sports ball includes one or more electronic components embedded or attached within the sports ball. The one or more electronic components track the movements of the sports ball in real time. Movement data for the sports ball is transmitted by the one or more electronic components and received by receivers installed within the sports arena. The movement data is then transmitted from the receivers with a time code to a server platform. The server platform is operable to collect, synchronize, aggregate and process various sports data in real time. The various sports data are received from various input devices, including but not limited to the sports ball with the one or more electronic components. The server platform is vendor agnostic and device agnostic; that is to say, the server platform complements any product from any vendor for data collection. Preferably, the one or more electronic components do not affect the original shape or weight of the sports ball. The positions of the one or more electronic components within the sports ball are designed appropriately so that signals from the one or more components do not interfere with each other and are not blocked by a player during a sports event. For example, during a football game, the football may be carried, tucked, or covered by a football player. The football player may block one or more signals from the one or more electronic components within the football when carrying, tucking, or covering the football. In one embodiment, the one or more electronic components are located inside the football with a certain distance away from either end of the football and/or within a certain distance between each other so that the signals from the electronic components are successfully received by receivers deployed in a football stadium.

FIG. 1 is a schematic diagram of a football with a pair of electronic tags with different orientations. A top view shows the football is an elongated spheroid. There is a lace region on the football. The two perspective views from either end of the football are shown with the embedded electronic tags. There are different orientations for each tag inside the football, for example, from A1 to A4, from B1 to B4, from C1 to C4, and from D1 to D4 as illustrated in FIG. 1.

FIG. 2 shows a side view and two end views of a football in one embodiment of the present invention. According to FIG. 2, the orientation for both of the electronic tags is A1 with gold antenna on each of the two electronic tags pointing away from each other.

The distance from one end of the football to the electronic tag on that end is defined as a in FIG. 2. The distance from one end of the football to the edge of the lace region on that end is defined as $A_{max}$ in FIG. 2. In one embodiment, a is set at 2.5 inches. Preferably, a is 4 inches. Note that a is not larger than $A_{max}$, which means that the position of the electronic tag on either end is not beyond the lace region.

The pair of electronic tags is positioned along the x axis of the football and suspended inside an inflatable bladder of the football. The supporting structure for the pair of electronic tags is made of strings, threads, cords, wires, springs, straps, bands, sheets, and combinations thereof.

The electronic tags inside the football are configured to maintain their positions in all types of play conditions including kicks, punts, passes, tackling, field goal attempts, and other football activities. The electronic tags are configured to work appropriately under all types of weather conditions.

Figure 3:
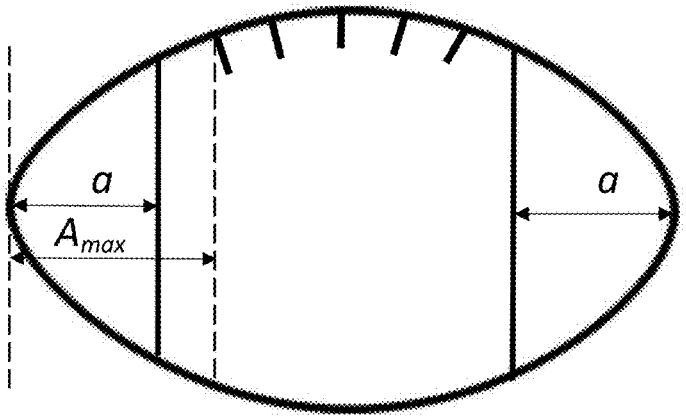
FIG. 3 shows a side view and two end views of a football in another embodiment of the present invention.
Figure 3:
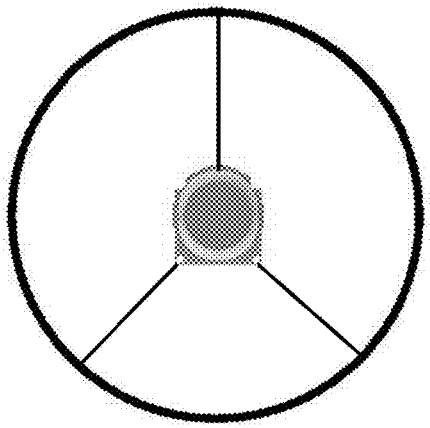
Figure 3:
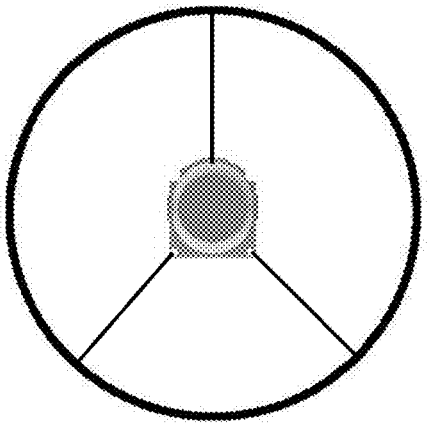

There are different ways to fix electronic components inside a football or other sports ball. In one embodiment, each electronic tag is fixed along they axis and the z axis by four strings 90 degrees apart with tension as shown in FIG. 2. According to another embodiment, each electronic tag is fixed on the yz-plane with three strings 120 degrees apart with tension as shown in FIG. 3.

In one embodiment, the electronic tags used in a football are provided by PLUS Location Systems. U.S. Patent Publication No. 2011/0304437 is incorporated herein by reference in its entirety. In other embodiments, electronic components from other providers are embedded in or attached to a football or other sports balls.

In one embodiment, the PLUS model 2112 modular tag is used in the present invention. The 2112 modular tag is a complete PLUS on Ultra-Wideband (UWB) tag design for integration into a PLUS printed wiring assembly (PWA) and enclosure. The 2112 modular tag is connected to a power source. FIG. 4 shows a Printed Wiring Board (PWB) schematics for the PLUS 2112 modular tag. FIG. 5 shows a Printed Wiring Assembly (PWA) for the PLUS 2112 modular tag. FIG. 6 is a PWA with battery for the PLUS 2112 modular tag. In one embodiment, the battery is a Panasonic CR2032, which is a coin-shaped non-rechargeable Lithium battery providing 3-volt DC source. The diameter is 0.79 inches (20 mm), the height is 0.13 inches (3.2 mm), and the weight is 3 grams.

The 2112 modular tag is operable with a power source ranging from runs 2-volt DC to 3-volt DC. It transmits a UWB packet in real time at a rate set at time of manufacture. The rate can be set to 1 Hz, 6 Hz, 8 Hz, 10 Hz, 15 Hz or 20 Hz. The 2112 modular tag meets the rules in Federal Communications Commission (FCC) section 15.212 concerning single modular transmitters. The FCC ID for the PLUS 2112 modular tag is ZEH0116.

Time-differences-of-arrival (TDOA) are analyzed for tag tracking. When a PLUS tag transmits a packet, a PLUS sensor that successfully receives the packet will send out information concerning the packet, including a precise time stamp. The difference in the time stamp between sensors gives the TDOA for that sensor pair/tag combination. In one embodiment, at least two PLUS sensors receive signals from a PLUS tag in order to determine a valid position for the PLUS tag. In another embodiment, at least three PLUS sensors receive signals from a PLUS tag in order to determine a valid position for the PLUS tag.

Figure 7:
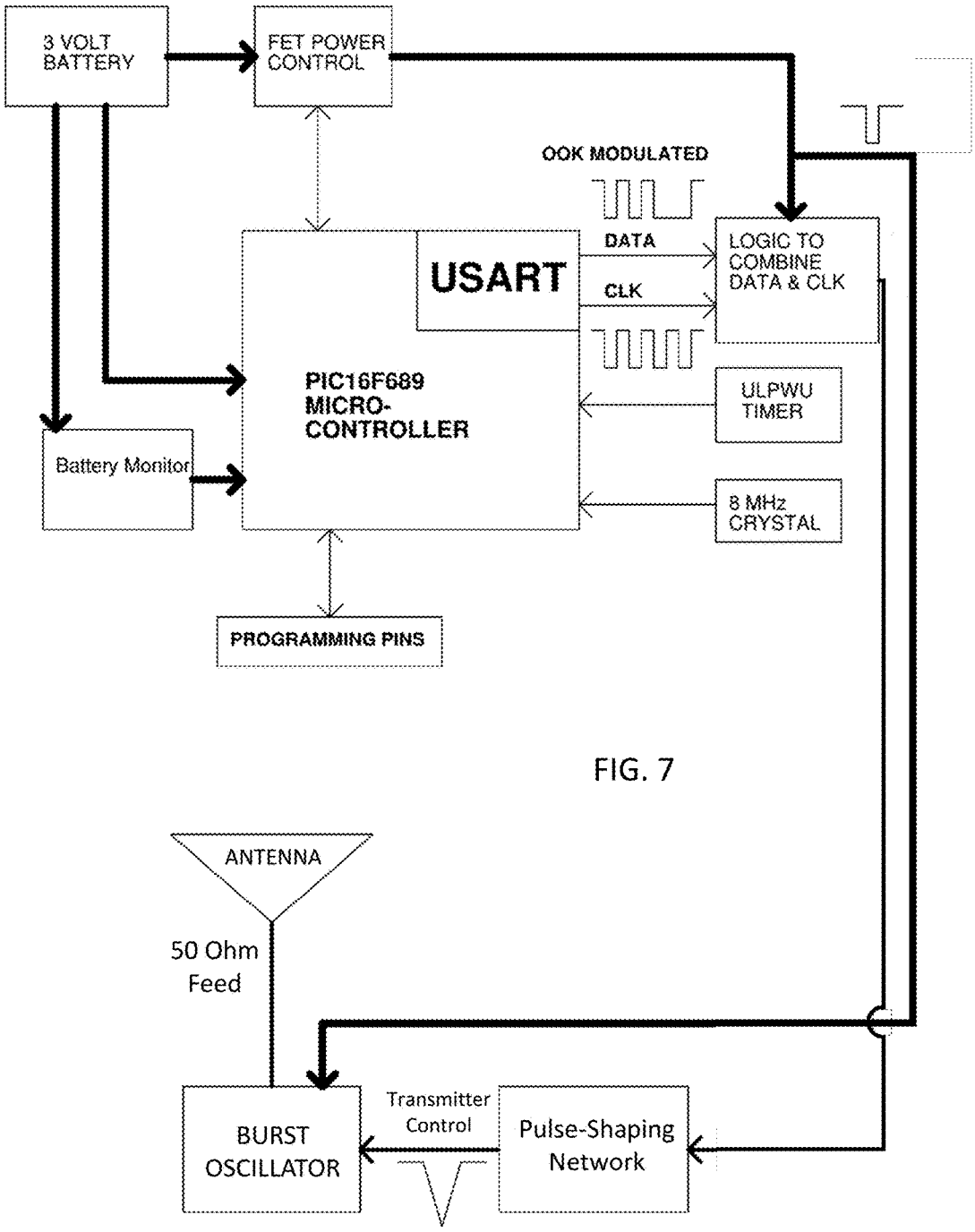
FIG. 7 is a block diagram of a PLUS 2112 modular tag circuitry in one embodiment of the present invention.

FIG. 7 is a block diagram of the PLUS 2112 modular tag circuitry in one embodiment of the present invention. The 2112 modular tag comprises a controlled and defined UWB transmitter. The 2112 tag is a small transmit-only device with an active transmit duty cycle of less than 0.0026%. The 2112 tag has one integrated antenna optimized for vertical applications. A data packet transmitted by the 2112 modular tag includes a tag identification code, status information, and time of arrival data. The data packet rate can be set at manufacture to 1 Hz, 6 Hz, 8 Hz, 10 Hz, 15 Hz or 20 Hz.

The 2112 modular tag comprises a microcontroller (also referred to as the processor) with timing controlled by a crystal, a burst mode oscillator transmitter, and an antenna. There is also a connection provided for an external 3-volt battery.

The microcontroller wakes up at one of 6 preset time intervals set by a component at the time of manufacture: 1, 6, 8, 10, 15, or 20 times a second. When the microcontroller wakes up, it turns on the rest of the tag circuitry, then calculates and sends a packet of multiple bits spaced 500 ns apart to key the transmitter. The transmitter generates a single UWB burst for each logic output ON presented to it. The transmitter then sends the UWB burst to the antenna. The antenna then broadcasts the UWB bursts.

The microcontroller then sets the rest of the tag circuitry on the 2112 modular tag to power down, goes back into its sleep mode, and waits until the set time interval is reached again to wake up and repeat the process.

On the 2112 modular tag, the tag circuitry transmitter drive from the microcontroller is a logic gate providing a fixed drive that does not overdrive the burst mode oscillator transmitter. The data rate to the transmitter is fixed from the microcontroller by software and the crystal time base. The modulation is set by the microcontroller and transmitter as simple on/off keying. The transmitter generates a UWB burst whenever the microcontroller clocks a logic high ON pulse to the transmitter input.

The antenna on the 2112 modular tag is part of the PWB layout and is permanently attached to the transmitter. The 2112 modular tag does not have shielding over the radio elements of the circuitry. The 2112 modular tag does not have regulation of its power supply and it operates from an unregulated 3V DC power source.

In one embodiment, the PLUS tracking system is a Real-Time Location System (RTLS) based UWB technology. The system comprises active tags, a network of sensors (receivers), and one or more synchronization distribution panels (SDPs). In one embodiment of the present invention, the PLUS tracking system is deployed in a football stadium for tracking a football during a football game, and the football is embedded with a pair of active PLUS tags.

The PLUS sensors are receive-only devices that are permanently mounted in the area of coverage. The sensors listen for and decode data packets from the active PLUS tags, and also measure the times of arrival of the data packets.

The one or more SDPs distribute, transmit, or communicate a timing signal to the multiple sensors so that that the times of arrival measured by the multiple sensors have a common time base. The one or more SDPs additionally power the sensors over an Ethernet cable, and pass the decoded data and measured times of arrival to other Ethernet devices.

In another embodiment, sensors installed within a sports venue are operable to receive data packets from tags included in a football, and transmit data packets to a server platform for processing and analytics.

In one embodiment, a server platform collects and processes data packets from the sensors, identifies the location of tags in real time, analyzes the movement and interaction of tags, and provides data visibility through dashboards, reports and application programming interface (APIs). In one embodiment, a display device is communicatively connected the server platform and operable to display the movement of the tags and related data visually. In one embodiment, the server platform is cloud-based and various display devices are connected to the server platform via network communication.

Although 'cloud computing' can generically be applied to any software as a service or to services interfacing through the Internet, in the present invention, 'cloud-based' computing refers to distributed computing among at least one server or more than one server.

Figure 8:
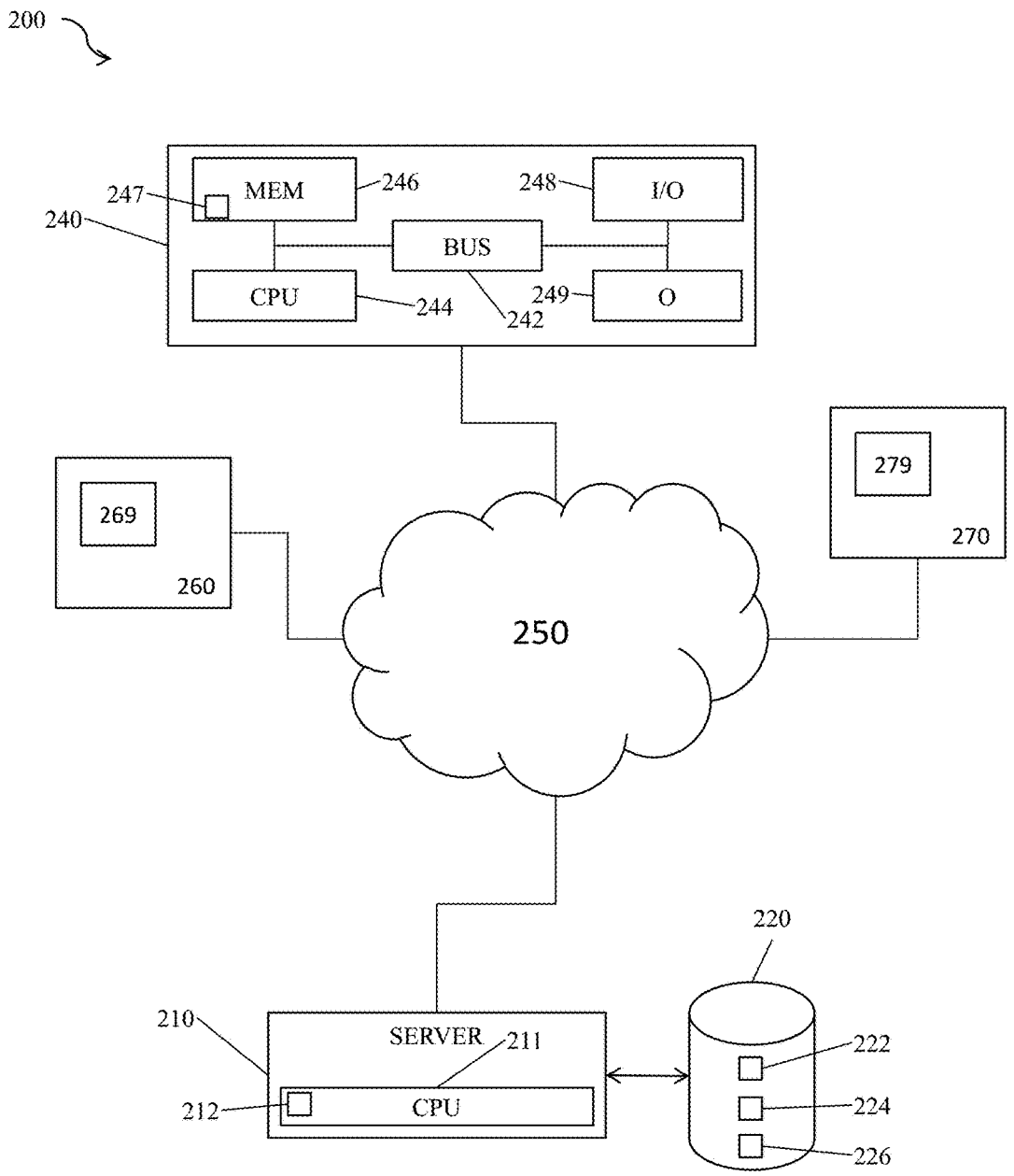
FIG. 8 is a schematic diagram of a cloud-based system of the present invention.

Referring now to FIG. 8, a schematic diagram illustrating a virtualized computing network used in of one embodiment of the invention for automated systems and methods is shown. As illustrated, components of the systems and methods include the following components and sub-components, all constructed and configured for network-based communication, and further including data processing and storage. As illustrated in FIG. 8, a basic schematic of some of the key components of a system according to the present invention are shown. The system 200 comprises a server 210 with a processing unit 211. The server 210 is constructed, configured and coupled to enable communication over a network 250. The server provides for user interconnection with the server over the network using a personal computer (PC) 240 positioned remotely from the server, the personal computer having instructions 247. Furthermore, the system is operable for a multiplicity of remote personal computers or terminals 260, 270, having operating systems 269, 279. For example, a client/server architecture is shown. Alternatively, a user may interconnect through the network 250 using a user device such as a personal digital assistant (PDA), mobile communication device, such as by way of example and not limitation, a mobile phone, a cell phone, smart phone, laptop computer, netbook, a terminal, or any other computing device suitable for network connection. Also, alternative architectures may be used instead of the client/server architecture. For example, a PC network, or other suitable architecture may be used. In one embodiment, user devices 240, 260, and 270 are operable to communicate with the server platform and display the movement of the sports ball assembly in the present invention. The network 250 may be the Internet, an intranet, or any other network suitable for searching, obtaining, and/or using information and/or communications. The system of the present invention further includes an operating system 212 installed and running on the server 210, enabling server 210 to communicate through network 250 with the remote, distributed user devices. The operating system may be any operating system known in the art that is suitable for network communication as described hereinbelow. Data storage 220 may house an operating system 222, memory 224, and programs 226.

Figure 9:
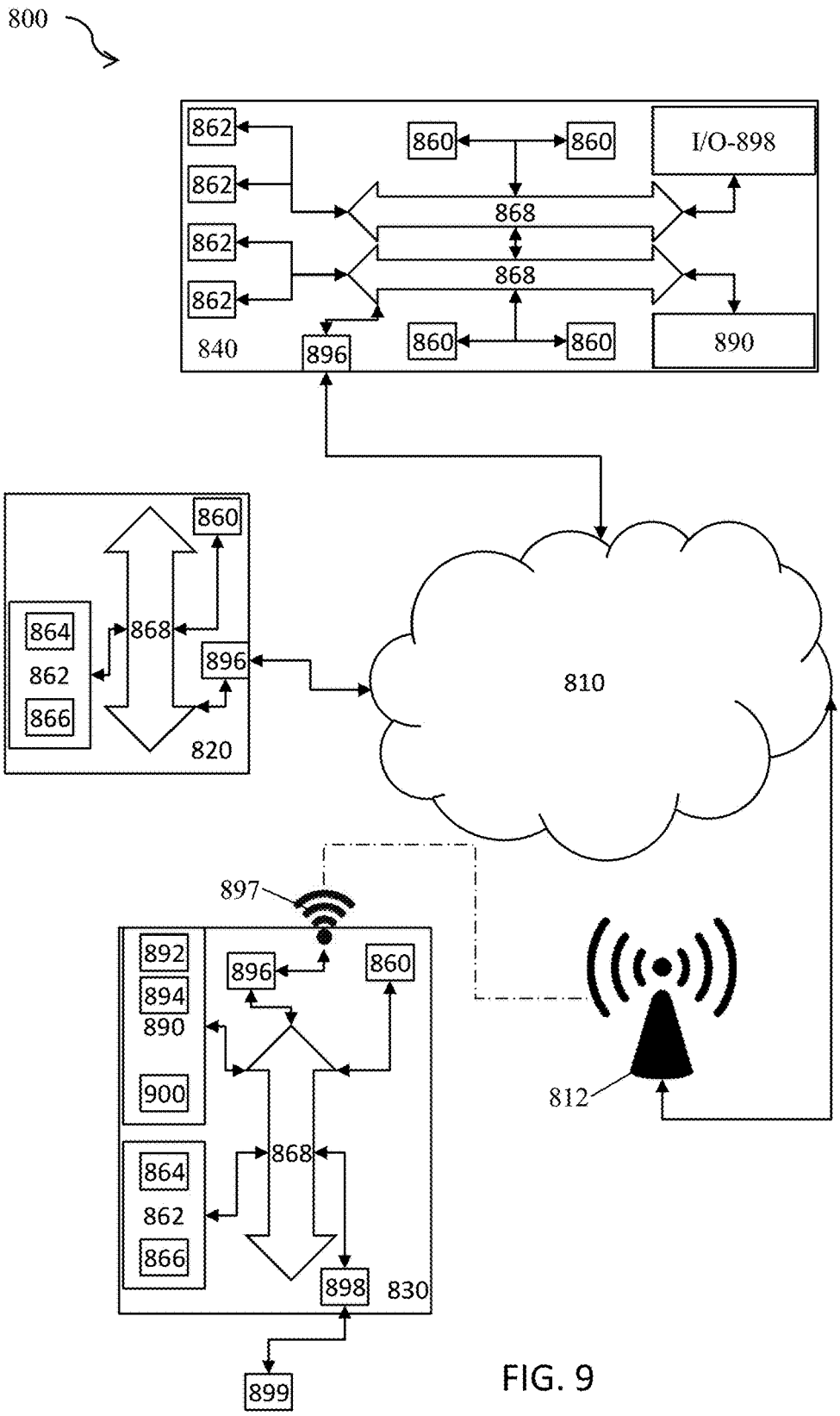
FIG. 9 is another schematic diagram of a cloud-based system of the present invention.

Additionally or alternatively to FIG. 8, FIG. 9 is a schematic diagram of an embodiment of the invention illustrating a computer system, generally described as 800, having a network 810 and a plurality of computing devices 820, 830, 840. In one embodiment of the invention, the computer system 800 includes a cloud-based network 810 for distributed communication via the network's wireless communication antenna 812 and processing by a plurality of mobile communication computing devices 830. In another embodiment of the invention, the computer system 800 is a virtualized computing system capable of executing any or all aspects of software and/or application components presented herein on the computing devices 820, 830, 840. In certain aspects, the computer system 800 may be implemented using hardware or a combination of software and hardware, either in a dedicated computing device, or integrated into another entity, or distributed across multiple entities or computing devices.

By way of example, and not limitation, the computing devices 820, 830, 840 are intended to represent various forms of digital computers 820, 840, 850 and mobile devices 830, such as a server, blade server, mainframe, mobile phone, a personal digital assistant (PDA), a smart phone, a desktop computer, a netbook computer, a tablet computer, a workstation, a laptop, and other similar computing devices. The components shown here, their connections and relationships, and their functions, are meant to be exemplary only, and are not meant to limit implementations of the invention described and/or claimed in this document. In one embodiment, computing devices 820, 830, 840 represent various display devices used for displaying the movement of the sports ball assembly in the present invention.

In one embodiment, the computing device 820 includes components such as a processor 860, a system memory 862 having a random access memory (RAM) 864 and a read-only memory (ROM) 866, and a system bus 868 that couples the memory 862 to the processor 860. In another embodiment, the computing device 830 may additionally include components such as a storage device 890 for storing the operating system 892 and one or more application programs 894, a network interface unit 896, and/or an input/output controller 898. Each of the components may be coupled to each other through at least one bus 868. The input/output controller 898 may receive and process input from, or provide output to, a number of other devices 899, including, but not limited to, alphanumeric input devices, mice, electronic styluses, display units, touch screens, signal generation devices (e.g., speakers) or printers.

By way of example, and not limitation, the processor 860 may be a general-purpose microprocessor (e.g., a central processing unit (CPU)), a graphics processing unit (GPU), a microcontroller, a Digital Signal Processor (DSP), an Application Specific Integrated Circuit (ASIC), a Field Programmable Gate Array (FPGA), a Programmable Logic Device (PLD), a controller, a state machine, gated or transistor logic, discrete hardware components, or any other suitable entity or combinations thereof that can perform calculations, process instructions for execution, and/or other manipulations of information.

In another implementation, shown in FIG. 9, a computing device 840 may use multiple processors 860 and/or multiple buses 868, as appropriate, along with multiple memories 862 of multiple types (e.g., a combination of a DSP and a microprocessor, a plurality of microprocessors, one or more microprocessors in conjunction with a DSP core).

Also, multiple computing devices may be connected, with each device providing portions of the necessary operations (e.g., a server bank, a group of blade servers, or a multiprocessor system). Alternatively, some steps or methods may be performed by circuitry that is specific to a given function.

According to various embodiments, the computer system 800 may operate in a networked environment using logical connections to local and/or remote computing devices 820, 830, 840, 850 through a network 810. A computing device 830 may connect to a network 810 through a network interface unit 896 connected to the bus 868. Computing devices may communicate communication media through wired networks, direct-wired connections or wirelessly such as acoustic, RF or infrared through a wireless communication antenna 897 in communication with the network's wireless communication antenna 812 and the network interface unit 896, which may include digital signal processing circuitry when necessary. The network interface unit 896 may provide for communications under various modes or protocols.

In one or more exemplary aspects, the instructions may be implemented in hardware, software, firmware, or any combinations thereof. A computer readable medium may provide volatile or non-volatile storage for one or more sets of instructions, such as operating systems, data structures, program modules, applications or other data embodying any one or more of the methodologies or functions described herein. The computer readable medium may include the memory 862, the processor 860, and/or the storage media 890 and may be a single medium or multiple media (e.g., a centralized or distributed computer system) that store the one or more sets of instructions 900. Non-transitory computer readable media includes all computer readable media, with the sole exception being a transitory, propagating signal per se. The instructions 900 may further be transmitted or received over the network 810 via the network interface unit 896 as communication media, which may include a modulated data signal such as a carrier wave or other transport mechanism and includes any delivery media. The term "modulated data signal" means a signal that has one or more of its characteristics changed or set in a manner as to encode information in the signal.

Storage devices 890 and memory 862 include, but are not limited to, volatile and non-volatile media such as cache, RAM, ROM, EPROM, EEPROM, FLASH memory or other solid state memory technology, discs (e.g., digital versatile disc (DVD), HD-DVD, BLU-RAY, compact disc (CD), CD-ROM) or other optical storage, magnetic cassettes, magnetic tape, magnetic disk storage, floppy disk, or other magnetic storage devices, or any other medium that can be used to store the computer readable instructions and which can be accessed by the computer system 800.

It is also contemplated that the computer system 800 may not include all of the components shown in FIG. 9, may include other components that are not explicitly shown in FIG. 9, or may utilize an architecture completely different than that shown in FIG. 9. The various illustrative logical blocks, modules, elements, circuits, and algorithms described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application (e.g., arranged in a different order or partitioned in a different way), but such implementation decisions should not be interpreted as causing a departure from the scope of the present invention.

Electronic components used for tracking sports balls are operable to transmit signals to sensors and/or receivers, which then communicate the signals to the server platform, via one or more wired or wireless communication protocols, including but not limited to any proprietary or standard wireless protocol Ultra-Wide Band (UWB) (e.g., IEEE 802.15.4), near field communication (NFC), Bluetooth, Wi-Fi (e.g., 802.11 protocol, etc.), ISO/IEC 18000, radio frequency systems (e.g., 900 MHz, 1.4 GHz, and 5.6 GHz communication systems), Zigbee, infrared, mobile broadband, Global System for Mobile Communications (GSM), GSM plus Enhanced Data rates for GSM Evolution (EDGE), Code-Division Multiple Access (CDMA), quadband, and other cellular protocols, Voice Over Internet Protocol (VoIP), and/or any other suitable protocol.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

What is claimed is:

1. A system for tracking a sports ball during a sporting event, comprising:
   - a sports ball assembly, at least two receivers, and a server processor in network communication within a sports arena;
   - wherein the sports ball assembly comprises at least one electronic circuit constructed and configured within a sports ball;
   - wherein the at least one electronic circuit is operable to generate and transmit data packets in real time at a predetermined rate, wherein the data packets comprise movement-related data for the sports ball assembly;
   - wherein the at least two receivers are operable to receive the data packets from the at least one electronic circuit, create time stamps for the data packets, and transmit the data packets with the time stamps to the server processor; and
   - wherein the server processor is operable to determine a movement of the sports ball assembly in real time or near real time based on the data packets and the time stamps received from the at least two receivers.

2. The system of claim 1, wherein the server processor is further operable to determine a location, an acceleration, and a direction of the sports ball assembly based on the data packets and the time stamps received from the at least two receivers.

3. The system of claim 2, further comprising a display device operable to display the movement of the sports ball assembly and related movement data comprising the location, the acceleration and the direction of the sports ball assembly.

4. The system of claim 1, wherein the at least one electronic circuit is positioned a predetermined distance away from at least one point on the surface of the sports ball.

5. The system of claim 1, wherein the at least one electronic circuit comprises a microprocessor, a transmitter, and an antenna.

6. The system of claim 5, wherein the microprocessor is operable to activate the at least one electronic circuit at the predetermined rate.

7. The system of claim 5, wherein the transmitter is operable to generate and transmit the data packets to the antenna for broadcasting at the predetermined rate.

8. The system of claim 1, wherein the network communication is via Ultra-Wide Band (UWB) protocol.

9. A method for tracking a sports ball during a sporting event, comprising:
   - providing a sports ball assembly, at least two receivers, and a server processor in network communication within a sports arena, wherein the sports ball assembly comprises at least one electronic circuit constructed and configured within a sports ball, wherein the at least one electronic circuit is positioned a predetermined distance away from at least one point on the surface of the sports ball;
   - the at least one electronic circuit generating and transmitting data packets comprising movement-related data for the sports ball assembly in real time at a predetermined rate;
   - the at least two receivers receiving the data packets from the at least one electronic circuit, creating time stamps for the data packets, and transmitting the data packets with the time stamps to the server processor; and the server processor determining a movement of the sports ball assembly in real time or near real time based on the data packets and the time stamps from the at least two receivers.

10. The method of claim 9, wherein the network communication is via Ultra-Wide Band (UWB) protocol, and wherein the data packets are UWB data packets.

11. The method of claim 9, wherein the at least one electronic circuit comprises a microprocessor, a transmitter, and an antenna.

12. The method of claim 11, further comprising the microprocessor activating the at least one electronic circuit at the predetermined rate.

13. The method of claim 11, further comprising the transmitter generating and transmitting the data packets to the antenna for broadcasting at the predetermined rate.

14. The method of claim 9, further comprising a display device displaying the movement of the sports ball assembly.

15. A sports ball assembly, comprising:

at least one electronic circuit constructed and configured within a sports ball;

wherein the sports ball is in network communication with a server processor via at least two receivers within a sports arena;

wherein each of the at least one electronic circuit comprises a microprocessor, a transmitter and an antenna;

wherein the at least one electronic circuit is positioned a predetermined distance from at least one point on the surface of the sports ball;

wherein the microprocessor is operable to activate the at least one electronic circuit at a predetermined rate;

wherein the transmitter is operable to generate and transmit UWB data packets to the antenna in real time at the predetermined rate;

wherein the antenna is operable to broadcast the UWB data packets;

wherein the at least two receivers are operable to receive the UWB data packets from the at least one electronic circuit, create time stamps for the UWB data packets, and transmit the UWB data packets with the time stamps to the server processor; and wherein the server processor is operable to determine a movement of the sports ball assembly in real time or near real time based on the data packets and the time stamps received from the at least two receivers.

16. The sports ball assembly of claim 15, wherein the at least one electronic circuit comprises a first electronic circuit and a second electronic circuit, wherein the sports ball is an American football, and wherein the first electronic circuit is positioned in a first end of the American football and a second electronic circuit is positioned in a second end of the American football.

17. The sports ball assembly of claim 16, wherein the distance from the first electronic circuit to the first end of the American football is about 4 inches and the distance from the second electronic circuit to the second end of the American football is about 4 inches.

18. The sports ball assembly of claim 15, wherein each of the UWB data packets comprises a tag identification code, status information, and time of arrival data.

19. The sports ball assembly of claim 15, wherein the predetermined rate is selected from the group consisting of 1 Hz, 6 Hz, 8 Hz, 10 Hz, 15 Hz and 20 Hz.

20. The sports ball assembly of claim 15, wherein the at least one electronic circuit further comprises a battery.

* * * * *